US012215470B2

(12) United States Patent
Pan et al.

(10) Patent No.: US 12,215,470 B2
(45) Date of Patent: Feb. 4, 2025

(54) WATER REPLACEMENT TYPE STORAGE FIELD CONSTRUCTION METHOD AND STORAGE FIELD

(71) Applicant: CCCC FIRST HARBOR ENGINEERING CO., LTD., Tianjin (CN)

(72) Inventors: Wei Pan, Tianjin (CN); Yiyong Li, Tianjin (CN); Zengjun Li, Tianjin (CN); Fanli Meng, Tianjin (CN); Naishu Zhang, Tianjin (CN); Jinfang Hou, Tianjin (CN); Chuang Du, Tianjin (CN)

(73) Assignee: CCCC FIRST HARBOR ENGINEERING CO., LTD., Tianjin (CN)

( * ) Notice: Subject to any disclaimer, the term of this patent is extended or adjusted under 35 U.S.C. 154(b) by 0 days.

(21) Appl. No.: 18/654,280

(22) Filed: May 3, 2024

(65) Prior Publication Data

US 2024/0368852 A1 Nov. 7, 2024

Related U.S. Application Data

(63) Continuation of application No. PCT/CN2023/116436, filed on Sep. 1, 2023.

(30) Foreign Application Priority Data

Oct. 21, 2022 (CN) ..... 202211293054.2

(51) Int. Cl.
*E02B 3/18* (2006.01)

(52) U.S. Cl.
CPC ..... *E02B 3/18* (2013.01)

(58) Field of Classification Search
CPC ..... E02B 3/18; E02D 19/04
See application file for complete search history.

(56) References Cited

U.S. PATENT DOCUMENTS 5,082,393 A 1/1992 Ringesten

FOREIGN PATENT DOCUMENTS

AU 1997014189 A1 6/1997
AU 1418997 A 7/1997
(Continued)

OTHER PUBLICATIONS

International Search Report for PCT/CN2023/116436.

*Primary Examiner* — Sean D Andrish
(74) *Attorney, Agent, or Firm* — J.C. PATENTS

(57) ABSTRACT

The present application provides a water replacement type storage field construction method, including the following steps: construction of a water-stop enclosure; construction of drainage after enclosing: after enclosing the water-stop enclosure, draining water in an enclosed range of the water-stop enclosure, exposing a pit, so as to form dry construction condition; construction of a stacking yard: under the dry construction condition, constructing the stacking yard on the pit, including constructing a lower low-level terrace and a higher high-level terrace; wherein the low-level terrace is lower than an average water level at an outer side of the water-stop enclosure, the high-level terrace is able to be used for walking a stacking-reclaiming device, and the stacking-reclaiming device is able to convey material to or from warehouses; and construction of the warehouses: constructing warehouses on the low-level terrace.

8 Claims, 4 Drawing Sheets

(56) References Cited

FOREIGN PATENT DOCUMENTS

| | | | |
|---|---|---|---|
| CN | 102345300 | A | 2/2012 |
| CN | 110080169 | A | 8/2019 |
| CN | 110921342 | A | 3/2020 |
| CN | 115573363 | A | 1/2023 |
| CN | 115852902 | A | 3/2023 |

WATER REPLACEMENT TYPE STORAGE FIELD CONSTRUCTION METHOD AND STORAGE FIELD

The present application is a continuation of the international application PCT/CN2023/116436 filed on Sep. 1, 2023, which claims the priority benefit of Chinese application No. 202211293054.2, filed on Oct. 21, 2022, entitled "water replacement type storage field construction method and application thereof", the entireties of the above identified applications are hereby incorporated by reference.

TECHNICAL FIELD

The present application belongs to the field of water transport engineering, and particularly relates to a water replacement type storage field construction method and a storage field obtained by the construction method.

BACKGROUND OF THE PRESENT INVENTION

The storage field is one of the main infrastructures for storing bulk cargo in the water transport engineering. Since the storage field needs to be close to the wharf, in the prior construction methods, an enclosure is often built first to enclose a part of the water area, the enclosed water area is then turned into land by hydraulic fill or land reclamation, and a storage field is constructed thereon.

The existing storage field construction methods have the following problems: In the range enclosed by the enclosure, the filler (e.g., sand and gravel) filled in water occupies a lot of the enclosed space and consumes a lot of engineering investment, and the enclosed space is reduced by the investment for filling. In the filling process, the filler mainly functions to turn a water environment into a water-free land environment, thereby facilitating material storage.

SUMMARY OF THE PRESENT INVENTION

In order to solve some problems in the prior art, the present application provides a water replacement type storage field construction method and a storage field.

A first aspect of the present application provides a water replacement type storage field construction method, including the following steps:

- construction of a water-stop enclosure: constructing an enclosure being able to stop water;
- construction of drainage after enclosing: after enclosing the water-stop enclosure, draining water in an enclosed range of the water-stop enclosure, exposing a pit, so as to form dry construction condition;
- construction of a stacking yard: under the dry construction condition, constructing the stacking yard on the pit, including constructing a lower low-level terrace and a higher high-level terrace; wherein the low-level terrace is lower than an average water level at an outer side of the water-stop enclosure, the high-level terrace is able to be used for walking a stacking-reclaiming device, and the stacking-reclaiming device is able to convey material to or from warehouses; and
- construction of the warehouses: constructing warehouses on the low-level terrace.

In some examples of the present application, the step of constructing of the water-stop enclosure further includes: firstly, inserting a plurality of cylindrical steel plates into a soft soil foundation by a vibration hammer set; then, inserting two auxiliary steel plates into the soft soil foundation between every two adjacent cylindrical steel plates along mortise grooves on outer walls of the cylindrical steel plates by the vibration hammer set, so as to close the gap between adjacent cylindrical steel plates; and, back-filling interiors of the cylindrical steel plates and an inner cavity formed between the two auxiliary steel plates to form the water-stop enclosure.

In some examples of the present application, the step of construction of drainage after enclosing further includes: after forming the dry construction condition, leveling the pit, usually without filling for elevation, and constructing the stacking yard on the leveled pit.

In some examples of the present application, the water replacement type storage field construction method further includes the construction of riprap mounds: constructing the riprap mounds at the inner and outer sides of the water-stop enclosure, respectively, so that the riprap mounds roughly form a right-angled trapezoid shape fitted with the water-stop enclosure at the inner and outer sides, and upper surfaces of the riprap mounds are roughly flush with an upper surface of the water-stop enclosure. A wave wall extending upward can be constructed in an upper portion of the water-stop enclosure or in an upper portion of the riprap mound at the outer side.

In some examples of the present application, in the step of constructing of the stacking yard, the low-level terrace is 3 m to 20 m lower than the average water level at the outer side of the water-stop enclosure.

In some examples of the present application, in the step of constructing of the stacking yard, an average depth from the pit to a top of the water-stop enclosure is L1, a depth from a surface of the low-level terrace to the top of the water-stop enclosure is L2, and $L2/L1 \geq 50\%$.

In some examples of the present application, in the step of constructing of the stacking yard, a water permeable cushion, a water blocking cushion, a waterproof layer and a baseplate layer are formed sequentially from bottom up in the drained pit, so as to form the low-level terrace. More specifically, the water permeable cushion is formed by paving water permeable material in the pit; the water blocking cushion is formed by casting cement or concrete on the water permeable cushion; the waterproof layer is formed by coating waterproof material or paving a physical waterproof layer on the water blocking cushion; and, the baseplate layer is formed by casting cement or concrete.

In some examples of the present application, the baseplate layer is further provided with ground beams arranged at intervals; and the ground beams are plate structures and extend downward into the pit.

In some examples of the present application, in the step of constructing of the warehouses, storage warehouses and ballast warehouses are arranged on the low-level terrace, wherein the ballast warehouses are distributed around the storage warehouses; the storage warehouses are able to be used for storing material, and the ballast warehouses are able to be used for filling ballasts.

In some examples of the present application, the storage warehouses and the ballast warehouses are elongated and arranged at intervals; adjacent storage warehouse and ballast warehouse share the same long sidewall, and the short sidewalls of multiple storage warehouses and multiple ballast warehouses in parallel form a common sidewall; wherein a width of the storage warehouse is greater than a width of the ballast warehouse.

In some examples of the present application, in the step of constructing of the stacking yard, the high-level terrace is constructed on the warehouses. More specifically, a main road of the high-level terrace is constructed in a direction substantially perpendicular to a length direction of the elongated warehouses; branch roads of the high-level terrace are formed above the ballast warehouses communicating with the main road; and, the main road and the branch roads allow the stacking-reclaiming device to walk thereon.

In some examples of the present application, support plates used for supporting the main road are arranged in the warehouses corresponding to the main road, and the support plates are steel plates or reinforced concrete plates vertically arranged; and, the long sidewalls of the ballast warehouses are made of reinforced concrete or steel structures and have a height substantially equal to a height of the main road of the high-level terrace to form the branch roads on the ballast warehouses, and the long sidewalls of the ballast warehouses are used as walking tracks of the stacking-reclaiming device.

In some examples of the present application, in upper portions of two long sidewalls of the same ballast warehouse, connecting beams for connecting the two long sidewalls are provided.

A second aspect of the present application provides application of a water replacement type storage field construction method in building a storage field at a port, which can adopt the construction method described in any one of the above examples.

A third aspect of the present application provides a water replacement type storage field, which can be constructed by the construction method described in any one of the above examples.

The water replacement type storage field includes a water-stop enclosure and a stacking yard; wherein the stacking yard is constructed in an internal space enclosed by the water-stop enclosure, and located on a pit formed inside the water-stop enclosure after water drainage. The stacking yard includes a lower low-level terrace and a higher high-level terrace; wherein the low-level terrace is lower than an average water level at an outer side of the water-stop enclosure, and warehouses are constructed on the low-level terrace; and, the high-level terrace is able to be used for walking a stacking-reclaiming device.

In some examples of the present application, the pit is leveled, usually without filling for elevation; and the stacking yard is located on the leveled pit.

In some examples of the present application, the water-stop enclosure includes a plurality of cylindrical steel plates and auxiliary steel plates located between adjacent cylindrical steel plates; wherein the cylindrical steel plates are distributed at intervals in a length direction of the water-stop enclosure; and the auxiliary steel plates are arc-shaped and are closely connected to the cylindrical steel plates through mortise grooves on the cylindrical steel plates. Two auxiliary steel plates arranged oppositely are provided between adjacent cylindrical steel plates, an arc-shaped convex surface of each auxiliary steel plate faces outward, and an inner cavity is formed; and, interiors of the cylindrical steel plates and the inner cavity of the auxiliary steel plates are back-filled with soil.

In some examples of the present application, riprap mounds are arranged at the inner and outer sides of the water-stop enclosure, respectively, and a wave wall extending upward is arranged on a top of the water-stop enclosure.

In some examples of the present application, the low-level terrace is 3 m to 20 m lower than the average water level at the outer side of the water-stop enclosure.

In some examples of the present application, an average depth from the pit to the top of the water-stop enclosure is L1, and a depth from a surface of the low-level terrace to the top of the water-stop enclosure is L2, where $100\% \geq L2/L1 \geq 50\%$.

In some examples of the present application, the low-level terrace includes a water permeable cushion, a water blocking cushion, a waterproof layer and a baseplate layer from bottom up. The water permeable cushion is formed by paving water permeable material in the pit; the water blocking cushion is formed by casting cement or concrete on the water permeable cushion; the waterproof layer is formed by coating waterproof material or paving a physical waterproof layer on the water blocking cushion; and, the baseplate layer is formed by casting cement or concrete.

In some examples of the present application, the baseplate layer is further provided with ground beams arranged at intervals, and the ground beams are plate structures and extend downward into the pit.

In some examples of the present application, storage warehouses and ballast warehouses are arranged on the low-level terrace, wherein the ballast warehouses are distributed around the storage warehouses, the storage warehouses are able to be used for storing material, and the ballast warehouses are able to be used for filling ballasts.

In some examples of the present application, the storage warehouses and the ballast warehouses are rectangular and arranged at intervals; adjacent storage warehouse and ballast warehouse share the same long sidewall, and the short sidewalls of multiple storage warehouses and multiple ballast warehouses in parallel form a common sidewall; wherein a width of the storage warehouse is greater than a width of the ballast warehouse.

In some examples of the present application, the high-level terrace is located on the warehouses, and includes a main road and branch roads communicated with the main road, allowing the stacking-reclaiming device to walk thereon; the main road is arranged in a direction substantially perpendicular to the rectangular warehouses; and, the branch roads are located above the ballast warehouses.

In some examples of the present application, support plates used for supporting the main road are arranged in the warehouses corresponding to the main road, and the support plates are steel plates or reinforced concrete plates vertically arranged; and, the long sidewalls of the ballast warehouses are made of reinforced concrete or steel structures and have a height substantially equal to a height of the main road of the high-level terrace to form the branch roads on the ballast warehouses, and the long sidewalls of the ballast warehouses are used as the foundation of the walking tracks of the stacking-reclaiming device.

In some examples of the present application, in upper portions of two long sidewalls of the same ballast warehouse, multiple connecting beams for connecting the two long sidewalls are provided.

A fourth aspect of the present application provides application of a water replacement type storage field in a storage field at a port, which can adopt the water replacement type storage field described in any one of the above examples.

Compared with the prior art, the beneficial effects of the present application are:

The water replacement type storage field provided by at least one embodiment of the present application adopts a water-stop enclosure to stop water instead of reclamation, changes the water environment into a water-free environment, and replaces the space occupied by the water body within the water-stop enclosure into storage space, which expands the stacking yard capacity, saves reclamation costs, and greatly improves the cost-effectiveness of the project.

The water replacement type storage field provided by at least one embodiment of the present application uses inserted cylindrical structures to reinforce the foundation of the enclosure and serve as a water stop and enclosure structure; it can not only quickly build a vehicle driving passage in the water, but also form a water-stop enclosure; meanwhile, the enclosure can be quickly built, forming dry construction condition for the stacking yard within the water-stop enclosure, creating parallel construction condition for the stacking yard and the water-stop enclosure, and greatly shortening the construction period.

wherein, 1 water-stop enclosure; 101 cylindrical structure; 1011 cylindrical steel plate; 1012 auxiliary steel plate; 1013 inner cavity; 2 pit; 3 stacking yard; 4 riprap mound; 5 wave wall; 6 low-level terrace; 601 water permeable cushion; 602 water blocking cushion; 603 waterproof layer; 604 baseplate layer; 6041 ground beam; 7 high-level terrace; 701 main road; 702 branch road; 8 warehouse; 801 storage warehouse; 802 ballast warehouse; 803 long sidewall; 804 common sidewall; 805 support plate; 806 connecting beam; and 9 stacking-reclaiming device.

DETAILED DESCRIPTION OF THE PRESENT INVENTION

The technical solutions of the present application will be described in detail below in combination with specific embodiments. However, it should be understood that elements, members, structures and features in one embodiment may also be advantageously incorporated into other embodiments without further description.

In the description of the present application, it should be noted that terms such as "first" and "second" are used for descriptive purposes only, and cannot be understood as indicating or implying the relative importance, or implicitly indicating the number of indicated technical features. Therefore, the features defined with "first" and "second" may explicitly or implicitly include one or more of these features.

Figure 7:
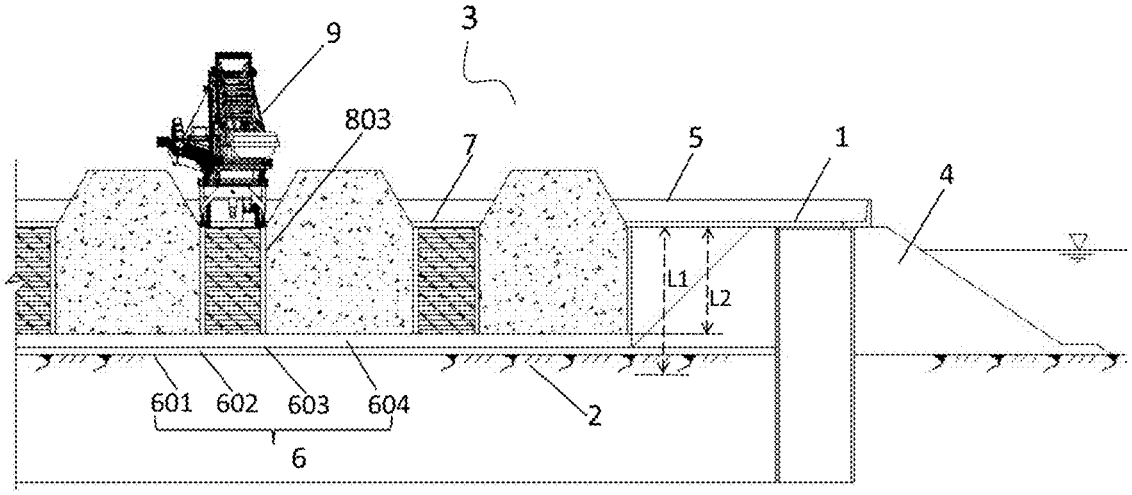
FIG. 7 is a front view of a storage yard in one embodiment.

In the description of the present application, it should be noted that the terms "up", "down", "bottom", "inner" and the like indicate an orientation or positional relationship based on the orientation or positional relationship shown in FIG. 7, merely for the convenience of describing the present application and the simplified description, but do not indicate or imply a devices or an element referred to must be of a particular orientation, constructed and operated in a particular orientation and therefore should not be construed as limiting the present application.

In the description of the present application, it should be noted that the terms "connect", "connecting" and "connected" should be understood in a broad sense unless otherwise clearly specified and limited. For example, they might be fixed connection, detachable connection, or integrated connection; might be direct connection or indirect connection through an intermediate medium, and might be internal connection of two elements. For those of ordinary skill in the art, the specific meanings of the above-mentioned terms in the present application can be understood under specific circumstances.

Figure 1:
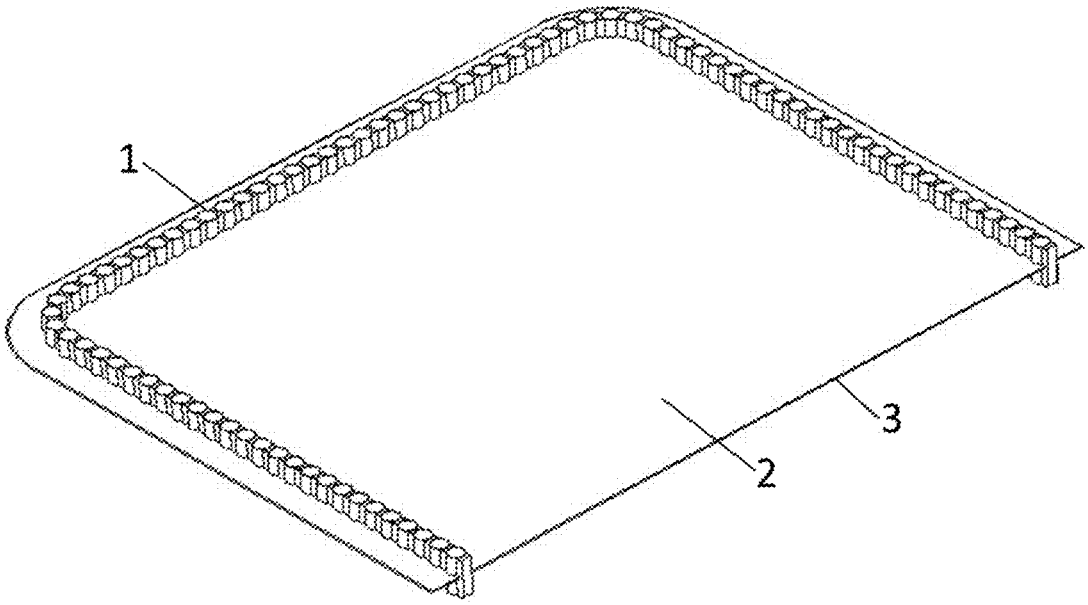
FIG. 1 is a schematic diagram of the construction of a water-stop enclosure.
Figure 2:
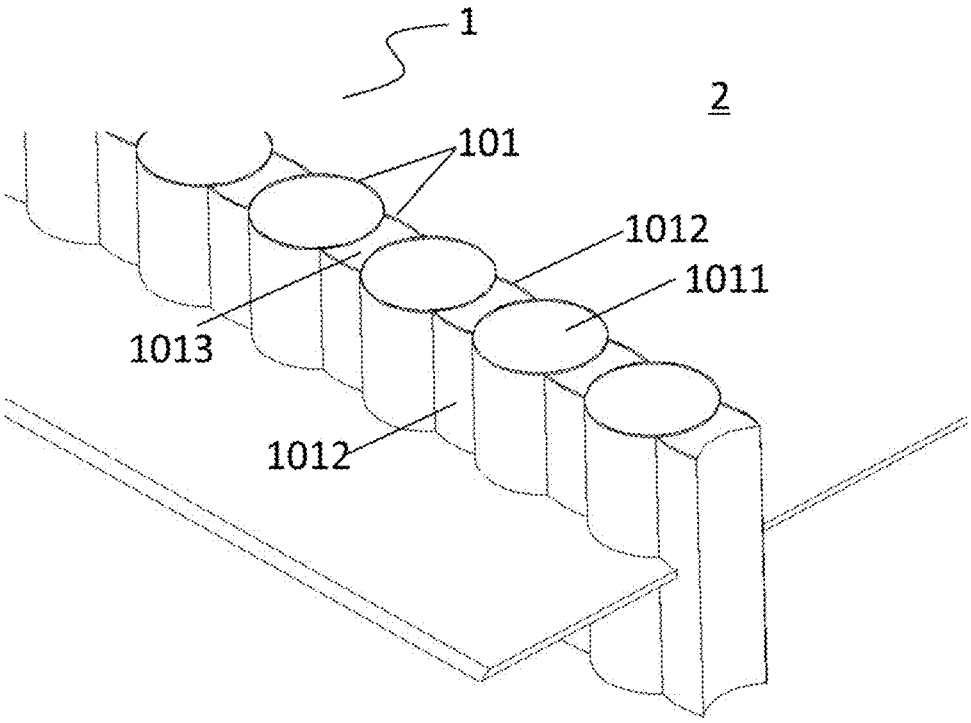
FIG. 2 is a partial enlarged view of FIG. 1.
Figure 3:
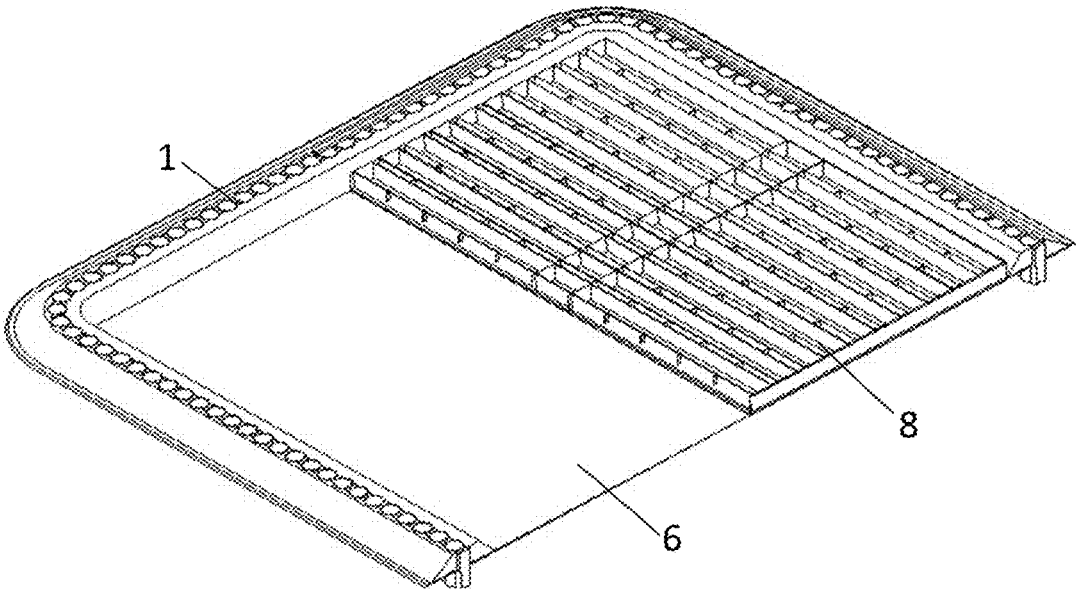
FIG. 3 is a schematic diagram of the construction of warehouses.

A first implementation of the present application provides a water replacement type storage field construction method, as shown in FIGS. 1-5, including the following steps:

(1) Construction of a Water-Stop Enclosure:

In one implementation, as shown in FIG. 2, a plurality of cylindrical structures 101 may be inserted in the water to reinforce the enclosure foundation and also act as water stop and enclosure structures to form a water-stop enclosure 1. Specifically, each cylindrical structure 101 includes a cylindrical steel plate 1011 and auxiliary steel plates 1012, as shown in FIGS. 1 and 2.

Firstly, each cylindrical steel plate 1011 is inserted into a soft soil foundation to enhance the shear strength of the soil foundation. The construction of inserting the cylindrical steel plates 1011 into the soft soil foundation may be completed by a process of hoisting a vibration hammer set using a crane ship to vibrate and sink.

Then, two auxiliary steel plates 1012 are inserted into the soft soil foundation between every two adjacent cylindrical steel plates 1011 along the mortise grooves (which are not shown and may be mortises in the prior art) on outer walls of the adjacent cylindrical steel plates 1011 to close the gap between the adjacent cylindrical steel plates 1011. Sealing material is applied at the junctions of the auxiliary steel plates 1012 and the mortise grooves to realize water tightness.

The auxiliary steel plates 1012 may also be inserted into the soft soil foundation by the process of hoisting a vibration hammer set using a crane ship to vibrate and sink. The sealing material may be a mixture of sawdust, asphalt or other materials, and is placed in the mortise grooves in advance so as to keep watertightness in the process of inserting the auxiliary steel plates 1012 into the mortise grooves. Or, the sealing material may also be cement paste, and is injected into the mortise grooves through preset pipes after the auxiliary steel plates 1012 are inserted into the mortise grooves, so as to realize water tightness.

Then, the interior of each cylindrical steel plate 1011 and the inner cavity 1013 formed between every two opposite auxiliary steel plates 1012 are back-filled to form the water-stop enclosure 1.

Sand and gravel may be used for the back-filling, and may be carried out on the water by using a belt ship, or may be carried by using a land device, so that the water-stop enclosure 1 keeps the shape of each cylindrical steel plate from shrinking by means of the silo pressure of the sand and gravel. The cylindrical steel plates are kept from buckling and breaking by means of the strength of the sand and gravel and the cylindrical structures 101, and the water-stop enclosure 1 is kept from toppling and slipping by means of the gravity of the sand and gravel, the gravity of the cylindrical structures 101 and the frictional resistance of the buried part, thereby overall stability is maintained. The top of the water-stop enclosure 1 may also be leveled and compacted to form a construction road for the construction and passage of construction machines and vehicles.

(2) Construction of Drainage after Enclosing

After the water-stop enclosure 1 is enclosed, water in the enclosed range is drained to expose a pit 2 so as to form dry construction condition. The pit 2 may be leveled according to the actual conditions for further construction of a stacking yard 3 inside the water-stop enclosure 1. The leveling is to level the pit completely or partially, excluding filling in the conventional sense. The main purpose of filling is for elevation, and the material consumption thereof will be significantly higher than that of the leveling.

(3) Construction of Riprap Mounds 4

Figure 4:
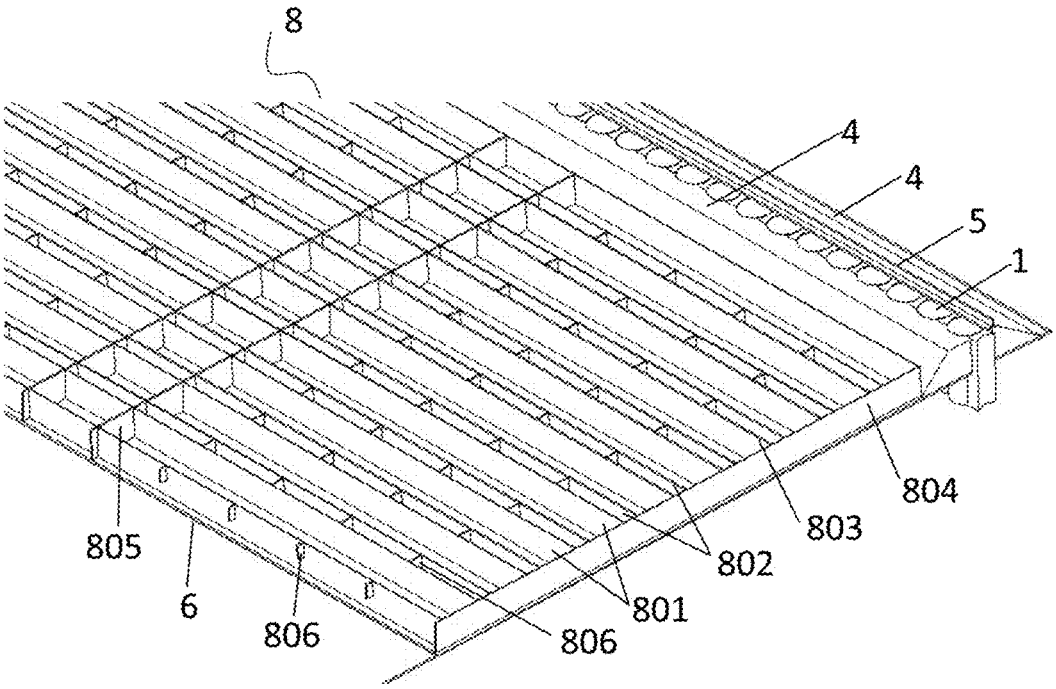
FIG. 4 is a partial enlarged view of FIG. 3.

As shown in FIG. 4, riprap mounds 4 may be constructed at the inner and outer sides of the water-stop enclosure 1, respectively. The riprap mounds 4 roughly form a right-angled trapezoid shape fitted with the water-stop enclosure 1 at the inner and outer sides respectively, and the upper surfaces of the riprap mounds 4 are roughly flush with the upper surface of the water-stop enclosure 1.

The parts of the riprap mounds 4 below the water surface may be dump-filled on the water by using a riprap ship, or may be partially dump-filled by using a land device and the left dump-filled on the water by using a riprap ship; and, the parts of the riprap mounds 4 above the water surface may be dump-filled by using a land device. The riprap mounds 102 at the inner side of the water-stop enclosure may be all filled by using a land device.

Figure 6:
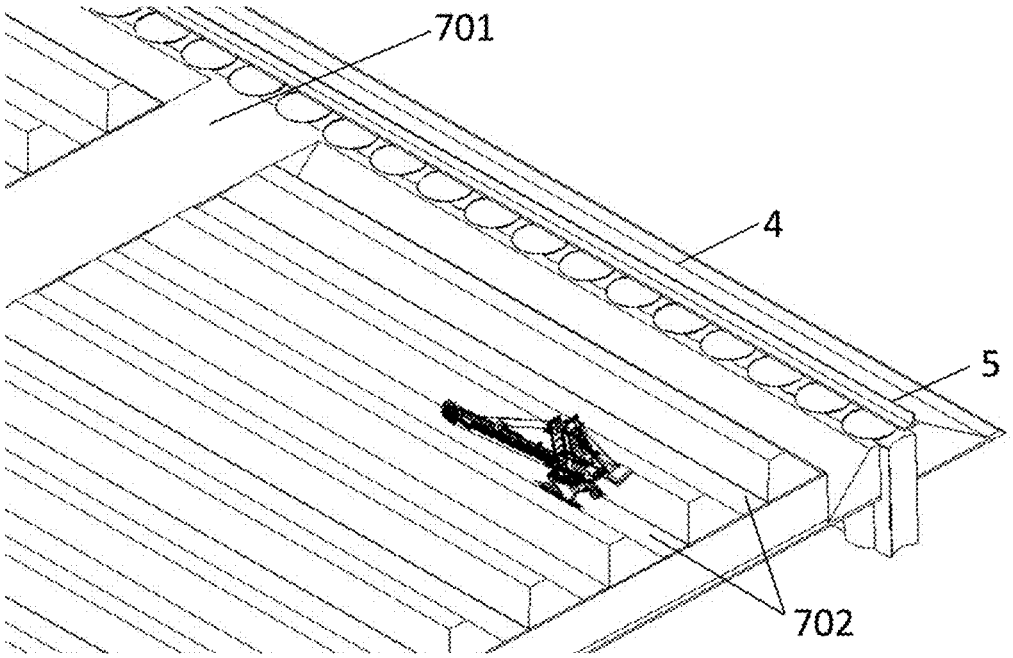
FIG. 6 is a partial enlarged view of FIG. 5.
Figure 8:
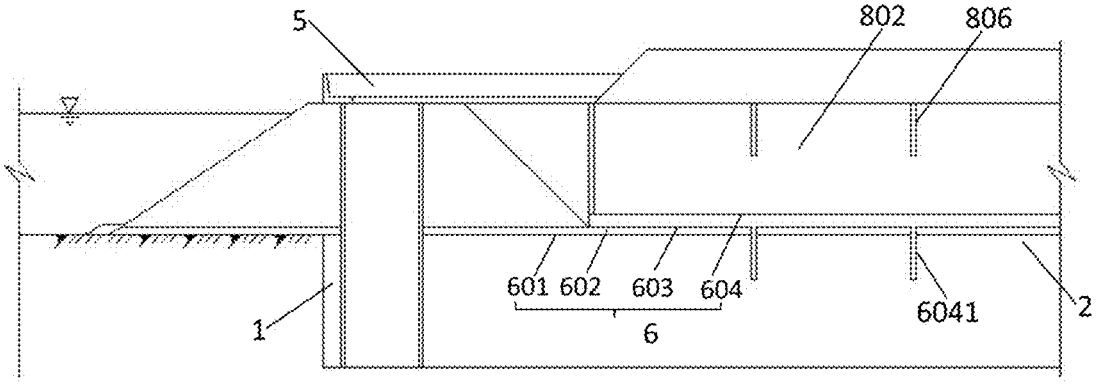
FIG. 8 is a side view of the storage yard in one embodiment.

As shown in FIGS. 6-8, a wave wall 5 extending upward may be constructed in an upper portion of the water-stop enclosure 1 or in upper portions of the riprap mounds 4 at the outer side, so as to reduce the amount of wave entering the water-stop enclosure 1. The wave wall 5 may be formed by casting reinforced concrete.

(4) Construction of a Stacking Yard 3

After the dry construction condition is formed, the construction of the stacking yard 3 is carried out, including constructing a low-level terrace 6 and a high-level terrace 7; wherein, the low-level terrace 6 is lower than the average water level at the outer side of the water-stop enclosure 1, and may be 3 m to 20 mm lower than the average water level according to the actual water depth and the construction environment so as to form the material stacking condition. Or, as shown in FIG. 7, the average depth from the pit 2 to the top of the water-stop enclosure 1 is L1 and the depth from the surface of the low-level terrace 6 to the top of the water-stop enclosure 1 is L2, then 100%≥L2/L1≥50%, for example, L2/L1≥60%, L2/L1≥65%, L2/L1≥70%, L2/L1≥75%, L2/L1≥80%, etc. Since the surface of the low-level terrace 6 is below the water surface, a larger available space is formed thereabove. The high-level terrace 7 can be built based on the low-level terrace 6, and has a larger height to form the conditions of mounting and running the stacking-reclaiming device 9.

More specifically, as shown in FIGS. 7 and 8, a water permeable cushion 601, a water blocking cushion 602, a waterproof layer 603 and a baseplate layer 604 are formed sequentially from bottom up in the drained pit 2, so as to form the low-level terrace 6. The water permeable cushion 601 can be formed by paving water permeable gravel in the pit 2. Since water seepage may occur in the pit 2, a buoyancy force will be produced to the low-level terrace 6 and may burst the low-level terrace 6. By providing the water permeable cushion 601, the pressure from water may be reduced or eliminated to protect other layers above the water permeable cushion from damage. Thus, the water permeable cushion 601 has the functions of filtration, decompression and drainage. The water blocking cushion 602 can be formed by casting cement or concrete on the water permeable cushion 601. The water blocking cushion 602 can block water to a certain extent, which facilitates the subsequence construction of the waterproof layer 603 and becomes a joint layer of the water permeable cushion 601 and the waterproof layer 603. The waterproof layer 603 can be formed by coating waterproof material or paving a physical waterproof layer (e.g., multilayer and partially laminated waterproof geotextile) on the water blocking cushion 602, and plays a main waterproof function to prevent water seepage from entering the surface of the low-level terrace 6. The baseplate layer 604 located on the waterproof layer 603 is conventionally formed by casting cement or concrete. As shown in FIG. 8, the baseplate layer 604 is further provided with ground beams 6041 which are arranged at intervals and extend downward. The ground beams 6041 are plate structures and extend into the pit 2, so that the bearing capability of the low-level terrace 6 is higher.

(5) Construction of Warehouses 8

As shown in FIG. 4, warehouses 8 including storage warehouses 801 and ballast warehouses 802 are arranged on the low-level terrace 6, wherein the ballast warehouses 802 are evenly distributed nearby the storage warehouses 801. The storage warehouses 801 are mainly used for storing materials (e.g., ore, coal, food, etc.), and the ballast warehouses 802 are mainly used for filling ballast (e.g., filling sand, stone, etc.) when the storage warehouses 801 are light. Considering that water seepage may occur on the bottom of the low-level terrace 6 (or the water blocking cushion 602), when there are materials with proper weight in the storage warehouses 801, a back pressure will be produced for the water seepage so as to overcome the buoyancy force of the water seepage. However, when there are few materials or no materials in the storage warehouses 801, in order to prevent the buoyancy force produced by water seepage from damaging the low-level terrace 6, ballasts may be filled in the ballast warehouses 802 to increase the back pressure of the low-level terrace 6 to the water seepage. It should be understood that the storage warehouses 801 and the ballast warehouses 802 may be mixed. For example, when there are many materials, the materials may be stored in both the storage warehouses and the ballast warehouses 802, so that the ballast warehouses 802 function as storage warehouses 801; and, when there are few materials, ballasts may also be filled in the storage warehouses 801, so that the storage warehouses 801 function as ballast warehouses 802.

The storage warehouses 801 and the ballast warehouses 802 may be arranged in regions, sections and layers, so that the space above the low-level terrace 6 is reasonably utilized. Since the low-level terrace 6 is located blow the average water level, the space provided above the low-level terrace is much larger than the space formed by a stacking yard obtained by a conventional filling method, so that the height and volume of the storage warehouses 801 are greatly increased, and more materials can be stored.

In one implementation, each storage warehouse 801 and each ballast warehouse 802 are elongated and arranged at intervals. As shown in FIGS. 3-6, each storage warehouses 801 and each ballast warehouses 802 are rectangular, adjacent storage warehouse 801 and ballast warehouse 802 share the same long sidewall 803, and the short sidewalls of multiple storage warehouses 801 and multiple ballast warehouses 802 in parallel form one common sidewall 804. In order to store more materials, the width of the storage warehouse 801 is greater than the width of the ballast warehouse 802.

In order to facilitate the long-term storage of materials, a waterproof layer may be formed on the four sides and bottom of each storage warehouse 801 (that is, a second waterproof layer may be constructed on the baseplate layer 604) to enhance the waterproof effect.

(6) Construction of the High-Level Terrace

Conventionally, the stacking-reclaiming device 9 used in a storage field mainly includes a stacker and a reclaimer, and is very heavy. In the normal use, in order to facilitate the walking of the stacking-reclaiming device 9, it is often necessary to drive piles on the foundation, then lay a track beam on the ground and lay a track for allowing the stacking-reclaiming device 9 to walk thereon on the track beam.

In the stacking yard 3 of the present application, the stacking-reclaiming device 9 also requires a special walking track. As described in the step (4), a high-level terrace 7 with a larger height may be built based on the low-level terrace 6, thereby forming the walking condition of the stacking-reclaiming device 9. However, if a plurality high-level terrace 7 passages are blindly built on the low-level terrace 6, the high-level terrace 7 will occupy more space, thereby squeezing the space for the warehouses 8.

Figure 5:
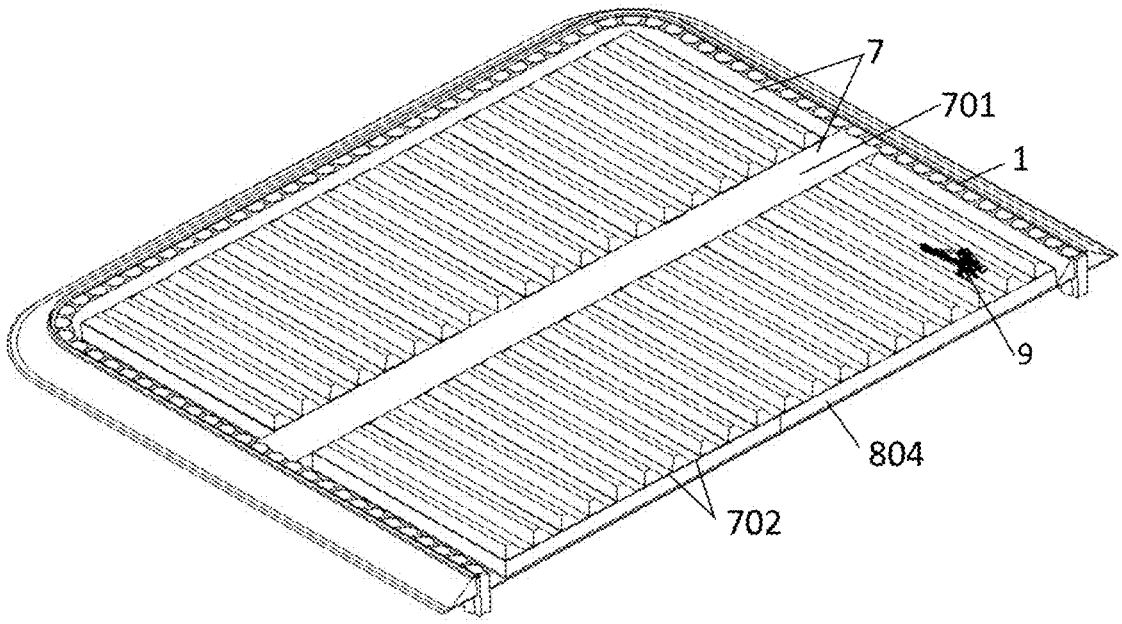
FIG. 5 is a schematic diagram of the warehouses after stacking.

In one implementation, in order to solve the above problem, the high-level terrace 7 can be built on the warehouses 8. More specifically, as shown in FIGS. 3-6, a main road 701 of the high-level terrace 7 is constructed in a direction roughly perpendicular to the length direction of the elongated or rectangular warehouses 8; and, the warehouses 8 corresponding below the main road 701 are provided with support plates 805, and the support plates 805 may be steel plates or reinforced concrete plates, forming the condition of supporting the stacking-reclaiming device 9 to walk on the main road 701. As shown in FIGS. 5 and 6, branch roads 702 of the high-level terrace 7 are formed above the ballast warehouses 802 to communicate with the main road 701, and can also allow the stacking-reclaiming device 9 to walk thereon. Specifically, the long sidewalls 803 of the ballast warehouses 802 can be made of reinforced concrete, steel structures or other materials with high strength, and have a height roughly equal to that of the high-level terrace 7 (or the main road 701), so that the walking track of the stacker and the reclaimer can be paved on the long sidewalls 803 of the ballast warehouses 802.

By providing the main road 701 and the branch roads 702 of the high-level terrace 7, the stacking-reclaiming device 9 from the main rod 701 can reach each branch road 702 so as to stack or reclaim material in the length direction of the storage warehouses 801. As shown in FIG. 6, the stacker can walk along the branch road 702 on the ballast warehouses 802 in the second row, so as to stack material in the storage warehouse 801 in the second row. FIGS. 5 and 6 are schematic diagrams after material stacking.

As shown in FIG. 4, connecting beams 806 are provided on the long sidewalls 803 of each ballast warehouse 802, and are located in the upper portions of the long sidewalls 803 of the ballast warehouse 802 to connect two adjacent long sidewalls 803 in the ballast warehouse 802. For example, the plurality of connecting beams 803 may be arranged between the two long sidewalls by welding. With this arrangement, the upper portions of the long sidewalls 803 can be connected together to overcome the outward lateral pressure applied to the long sidewalls 803 by the above load (e.g., the stacker/reclaimer), thereby improving the bearing stability.

It is to be noted that the order of the steps in the implementation is merely a descriptive order and can be adjusted according to actual needs, so this descriptive order does not constitute an absolute limitation to the present application.

In this implementation, by directly building the low-level terrace 6 in the pit 2 and making the low-level terrace 6 lower than the average water level at the outer wide, the staking yard/warehouse space is increased. Furthermore, in the implementation, since most of the area in the pit 2 is directly used as the stacking yard/warehouses, the conventional engineering of filling the pit 2 is avoided, a large amount of consumption of the filler and labor and machinery is saved, and the cost-effectiveness ratio of engineering is greatly improved.

A second implementation of the present application provides a water replacement type storage field, which can be constructed by the construction method described in any one of the above implementations.

The water replacement type storage field includes a water-stop enclosure 1 and a stacking yard 3, wherein an outer side of the water-stop enclosure 1 abuts to water body; and, the stacking yard 3 is formed in an inner space enclosed by the water-stop enclosure 1 and located on a pit 2 formed after draining water in the water-stop enclosure 1.

The water-stop enclosure 1 has a water stop function and prevents the water body at the outer side from entering the water-stop enclosure 1. The water-stop enclosure 1 may be constructed by a method for constructing an enclosure 1 in the prior art. As one implementation, the water-stop enclosure 1 includes a plurality of cylindrical steel plates 1011 and auxiliary steel plates 1012 located between adjacent cylindrical steel plates 1011. The cylindrical steel plates 1011 are cylindrical, and are distributed at intervals in the length direction of the water-stop enclosure 1. The auxiliary steel plates 1012 are arc-shaped, and are closely connected with the cylindrical steel plates 1011 through mortise grooves on the cylindrical steel plates 1011 to stop water. In one implementation, two auxiliary steel plates 1012 arranged oppositely are provided between adjacent cylindrical steel plates, the arc-shaped convex surface of each auxiliary steel plate 1012 faces outward, and an inner cavity 1013 is formed. Backfilling soil is back-filled to the interiors of the cylindrical steel plates 1011 and the inner cavities 1012 to increase the stability of the water-stop enclosure 1.

Optionally, riprap mounds 4 are arranged at the inner and outer sides of the water-stop enclosure 1, respectively. Thus, the lateral pressure on the water-stop enclosure 1 by the stacking material on the inner side can be reduced and a back pressure can be produced for the foundation; the acting force on the water-stop enclosure 1 by the wave or water flow is reduced, and a back pressure is produced for the foundation; and, the stability of the water-stop enclosure 1 is improved. A wave wall 5 may be provided on the top of the water-stop enclosure 1 to reduce overtopping waves.

The stacking yard 3 includes a lower low-level terrace 6 and a higher high-level terrace 7. The low-level terrace 6 includes a water permeable cushion 601, a water blocking cushion 602, a waterproof layer 603 and a baseplate layer 604 distributed bottom up. The water permeable cushion 601 has a water permeable function, may be formed by paving water permeable material (e.g., gravel, sand) in the pit 2, and has a thickness of 200 mm to 3000 mm. The water blocking cushion 602 is a cement layer or a concrete layer, has a certain water blocking effect, and has a thickness of 100 mm to 300 mm. The waterproof layer 603 is formed by coating waterproof material or paving a physical waterproof layer on the water blocking cushion 602, and has a thickness of 0.1 mm to 10 mm. The baseplate layer 604 is a cement layer or a concrete layer which is a working surface layer, and has a thickness of 300 mm to 2500 mm. The baseplate layer 604 is further provided with ground beams 6041 arranged at intervals, and the ground beams 6041 are a plurality of plate structures arranged in parallel and are formed by extending the baseplate layer 604 downward.

The surface of the low-level terrace 6 is at least 1 m (for example, 1 m to 20 m, such as 2 m, 3 m, 5 m, 8 m, 10 m, 12 m, 15 m or 18 m) lower than the average water level at the outer side of the water-stop enclosure 1. The space originally occupied by the water body is utilized, and the material storage space is greatly increased.

Warehouses 8 including storage warehouses 801 and ballast warehouses 802 are arranged on the low-level terrace 6. The storage warehouses 801 and the ballast warehouses 802 are distributed adjacent to each other. The storage warehouses 801 are used for storing material, and the ballast warehouses 802 are used for filling ballasts to complement the weight of the storage warehouses 801 when the weight of the storage warehouses 801 is insufficient, to increase the downward loading force of the low-level terrace 6.

As shown in FIG. 4, in one implementation, the storage warehouses 801 and the ballast warehouses 802 are rectangular and arranged at intervals, and the width of the storage warehouses 801 is greater than that of the ballast warehouses 802. Adjacent storage warehouses 801 and ballast warehouses 802 share the same long sidewall 803, and the short sidewalls of multiple storage warehouses 801 and multiple ballast warehouses 802 in parallel form one common sidewall 804.

The high-level terrace 7 can be built on the low-level terrace 6 and used for allowing the stacking-reclaiming device 9 to walk thereon. In one implementation, the high-level terrace 7 includes a main road 701 and a plurality of branch roads 702 communicated with the main road 701. As shown in FIGS. 3-6, the main road 701 is arranged perpendicular to the length direction of the storage warehouses 801 and the ballast warehouses 802 and located above the storage warehouses 801 and the ballast warehouses 802, and the branch roads 702 are formed above the ballast warehouses 802.

Further, support plates 805 are vertically arranged in the warehouses 8 (the storage warehouses 801 and the ballast warehouses 802) located below the main road 701, and are reinforced concrete plates or steel plates used for supporting the main road 701. The long sidewalls 803 of the ballast warehouses are reinforced concrete and steel structures and have a height equal to the height of the main road 701, so that the upper portions of the ballast warehouses 802 act as the branch roads 702 for paving the track of the stacking-reclaiming device 9, as shown in FIG. 7. In addition, a plurality of connecting beams 806 can be arranged in each ballast warehouse 802 and is located between the upper portions of two opposite long sidewalls 803 of the ballast warehouse to connect the two sidewalls, thereby improving the pressure resistance. In the present implementation, the long sidewalls of the ballast warehouse can also be used as the foundation of the walking track of the stacking-reclaiming device, without occupying the additional space for establishing the track foundation, so that the storage space of the warehouses 8 is increased.

The embodiments are only described as preferred embodiments of the present application, and are not intended to limit the scope of the present application. Various modifications and improvements made on the technical solutions of the present application by ordinary skill in the art without departing from the design spirit of the present application shall fall within the protective scope confirmed by the claims of the present application.

The invention claimed is:

1. A water replacement type storage field construction method, comprising:

constructing an enclosure being able to stop water;

draining water in an area enclosed by the enclosure to expose a pit, so as to form dry construction condition;

under the dry construction condition, constructing a stacking yard on the pit, including constructing a lower low-level terrace and a higher high-level terrace; wherein the low-level terrace is lower than an average water level at an outer side of the enclosure, the high-level terrace is able to be used for walking a stacking-reclaiming device, and the stacking-reclaiming device is able to convey material to or from warehouses;

constructing the warehouses on the low-level terrace;

wherein the warehouses include storage warehouses and ballast warehouses arranged on the low-level terrace, the ballast warehouses are distributed around the storage warehouses, the storage warehouses are able to be used for storing material, and the ballast warehouses are able to be used for filling ballasts;

wherein the storage warehouses and the ballast warehouses are elongated and arranged at intervals; adjacent storage warehouse and ballast warehouse share a same long sidewall, and short sidewalls of a plurality of the storage warehouses and the ballast warehouses in parallel form a common sidewall; wherein a width of the storage warehouses is greater than a width of the ballast warehouses;

wherein a main road of the high-level terrace is constructed on the storage warehouses and the ballast warehouses in a direction substantially perpendicular to a length direction of the storage warehouses and the ballast warehouses; branch roads of the high-level terrace are formed on the ballast warehouses and connected to the main road; and the main road and the branch roads allow the stacking-reclaiming device to walk thereon; and wherein support plates for supporting the main road are arranged in the storage warehouses and the ballast warehouses corresponding to the main road, and the support plates are steel plates or reinforced concrete plates vertically arranged; the long sidewalls of the ballast warehouses are made of reinforced concrete or steel structures and have a height substantially equal to a height of the main road of the high-level terrace to form the branch roads on the ballast warehouses, and the long sidewalls of the ballast warehouses are used as walking tracks of the stacking-reclaiming device; and connecting beams are disposed at upper portions of two long sidewalls of the same ballast warehouse to connect the two long sidewalls.

2. The water replacement type storage field construction method according to claim 1, wherein the low-level terrace is 3 m to 20 m lower than the average water level at the outer side of the enclosure.

3. The water replacement type storage field construction method according to claim 1, wherein an average depth from a bottom of the pit to an upper surface of the enclosure is L1, a depth from an upper surface of the low-level terrace to the upper surface of the enclosure is L2, and $L2/L1 \geq 50\%$.

4. The water replacement type storage field construction method according to claim 1, after forming the dry construction condition, further comprising leveling the pit to form a leveled pit without filling for elevation, and constructing the stacking yard on the leveled pit.

5. The water replacement type storage field construction method according to claim 1, wherein the constructing the enclosure being able to stop water includes: firstly, inserting a plurality of cylindrical steel plates into a soft soil foundation by a vibration hammer set; then, inserting two auxiliary steel plates into the soft soil foundation between every two adjacent cylindrical steel plates along mortise grooves on outer walls of the cylindrical steel plates by the vibration hammer set, so as to close a gap between adjacent cylindrical steel plates; and, then back-filling interiors of the cylindrical steel plates and an inner cavity formed between the two auxiliary steel plates to form the enclosure;

the water replacement type storage field construction method further comprises: constructing an inner riprap mount at an inner side of the enclosure and an outer riprap mount at an outer side of the step enclosure, respectively, so that the inner and outer riprap mounds substantially form a right-angled trapezoid shape fitted with the enclosure at the inner and outer sides of the enclosure; and an upper surface of the inner riprap mount and an upper surface of the outer riprap mount are substantially flush with an upper surface of the enclosure; and a wave wall extending upward is constructed on the upper surface of the enclosure or on the upper surface of the outer riprap mound.

6. The water replacement type storage field construction method according to claim 1, wherein after draining water in the area enclosed by the enclosure, a water permeable cushion, a water blocking cushion, a waterproof layer and a baseplate layer are formed sequentially from bottom up in the pit, so as to form the low-level terrace; wherein the water permeable cushion is formed by paving water permeable material in the pit; the water blocking cushion is formed by casting cement or concrete on the water permeable cushion; the waterproof layer is formed by coating waterproof material or paving a physical waterproof layer on the water blocking cushion; and the baseplate layer is formed by casting cement or concrete.

7. A water replacement type storage field construction method, comprising:

constructing an enclosure being able to stop water;

draining water in an area enclosed by the enclosure to expose a pit, so as to form dry construction condition;

under the dry construction condition, constructing a stacking yard on the pit, including constructing a lower low-level terrace and a higher high-level terrace; wherein the low-level terrace is lower than an average water level at an outer side of the enclosure, the high-level terrace is able to be used for walking a stacking-reclaiming device, and the stacking-reclaiming device is able to convey material to or from warehouses;

constructing the warehouses on the low-level terrace;

wherein the warehouses include storage warehouses and ballast warehouses arranged on the low-level terrace, the ballast warehouses are distributed around the storage warehouses, the storage warehouses are able to be used for storing material, and the ballast warehouses are able to be used for filling ballasts;

wherein the constructing the enclosure being able to stop water includes: firstly, inserting a plurality of cylindrical steel plates into a soft soil foundation by a vibration hammer set; then, inserting two auxiliary steel plates into the soft soil foundation between every two adjacent cylindrical steel plates along mortise grooves on outer walls of the cylindrical steel plates by the vibration hammer set, so as to close a gap between adjacent cylindrical steel plates; and, then back-filling interiors of the cylindrical steel plates and an inner cavity formed between the two auxiliary steel plates to form the enclosure;

the water replacement type storage field construction method further comprises: constructing an inner riprap mound at an inner side of the enclosure and an outer riprap mound at an outer side of the enclosure, respectively, so that the inner and outer riprap mounds substantially form a right-angled trapezoid shape fitted with the enclosure at the inner and outer sides of the enclosure; and an upper surface of the inner riprap mound and an upper surface of the outer riprap mound are substantially flush with an upper surface of the enclosure; and a wave wall extending upward is constructed on the upper surface of the enclosure or on the upper surface of the outer riprap mound.

8. A water replacement type storage field construction method, comprising:

constructing an enclosure being able to stop water;

draining water in an area enclosed by the enclosure to expose a pit, so as to form dry construction condition;

under the dry construction condition, constructing a stacking yard on the pit, including constructing a lower low-level terrace and a higher high-level terrace; wherein the low-level terrace is lower than an average water level at an outer side of the enclosure, the high-level terrace is able to be used for walking a stacking-reclaiming device, and the stacking-reclaiming device is able to convey material to or from warehouses;

wherein the low-level terrace comprises a water permeable cushion, a water blocking cushion, a waterproof layer and a baseplate layer formed sequentially from bottom up in the pit, the water permeable cushion is formed by paving water permeable material in the pit, the water blocking cushion is formed by casting cement or concrete on the water permeable cushion, the waterproof layer is formed by coating waterproof material or paving a physical waterproof layer on the water blocking cushion, and the baseplate layer is formed by casting cement or concrete;

constructing the warehouses on the low-level terrace;

wherein the warehouses include storage warehouses and ballast warehouses arranged on the low-level terrace, the ballast warehouses are distributed around the storage warehouses, the storage warehouses are able to be used for storing material, and the ballast warehouses are able to be used for filling ballasts.

* * * * *